US005826844A

United States Patent [19]

Purdy

[11] Patent Number: 5,826,844

[45] Date of Patent: Oct. 27, 1998

[54] BUCKET BRACKETS

[76] Inventor: James E. Purdy, 18 Temple Ave., Hudson, Mass. 01749

[21] Appl. No.: 645,417

[22] Filed: May 13, 1996

[51] Int. Cl.[6] ..... E06C 7/14

[52] U.S. Cl. ..... 248/210; 248/211

[58] Field of Search ..... 248/210, 211, 248/228.2, 228.6, 228.7, 205.1, 231.81, 231.71

[56] References Cited

U.S. PATENT DOCUMENTS

| | | | |
|---|---|---|---|
| 802,861 | 10/1905 | Hetherington | 248/210 |
| 1,880,319 | 10/1932 | Iasillo | 248/211 |
| 2,703,215 | 3/1955 | Weiss | 248/210 |
| 2,883,134 | 4/1959 | O'Halloran | 248/210 |
| 3,052,442 | 9/1962 | Rankin, Jr. | 248/210 |
| 3,125,317 | 3/1964 | Law | 248/210 |
| 3,227,411 | 1/1966 | Treutler | 248/210 |
| 3,603,548 | 9/1971 | Meyer, III | 248/211 |
| 3,661,351 | 5/1972 | Olsen | 248/210 |
| 3,964,711 | 6/1976 | Lund | 248/311.2 |
| 4,074,882 | 2/1978 | Anderson | 248/228.1 |
| 4,077,595 | 3/1978 | Carter et al. | 248/210 |
| 4,386,753 | 6/1983 | Smith | 248/210 |
| 4,964,601 | 10/1990 | Dishman | 248/210 |
| 5,118,059 | 6/1992 | Mainer | 248/215 |

FOREIGN PATENT DOCUMENTS

| | | | |
|---|---|---|---|
| 1544265 | 4/1979 | United Kingdom | 248/210 |

*Primary Examiner*—Leslie A. Braun
*Assistant Examiner*—Anita M. King
*Attorney, Agent, or Firm*—Ronald R. Kilponen

[57] ABSTRACT

A bracket designed to support a paint bucket or similar vessel to the outside of a conventional modern ladder comprised of two rails and a plurality of rungs consisting of a generally—U-shaped form with the capability of attachment to a band and shaped so as to firmly hold onto a rail of said ladder and yet be easy to remove from the ladder with a simple upward motion. One segment, the inner segment is shaped to conform on its lower surface to the upper flat surface of a modern ladder rung. Another segment is of sufficient length to cover the width of a ladder rail and is set to the first segment so that the surface of its greatest plane is at an angle of 95 to 115 degrees to the plane of the first segment's lower surface. The third segment has on its largest surface a means of attachment to a band which may allow movement of the bracket along said band, said band may be adjustable in circumference. A further variation consists of generally—L-shaped form having a first segment as described above and a second segment at a right angle to the first segment of sufficient length to cover the rail of a ladder and at its outer end a formation which can mate to a properly formed protrubence on a molded vessel to allow said vessel to be suspended from a rail of said ladder and allow the bail of said vessel to lie in a resting position and the opening of said vessel to be free of any obstructions.

7 Claims, 3 Drawing Sheets

BUCKET BRACKETS

BACKGROUND OF INVENTION

The present invention relates generally to a means of hanging a vessel from a ladder in the most convenient manner possible. Conventional paint buckets and cans are provided with a carrying handle known as a bail which consists of an elongated rod which is bent into a semi-circle. The ends of the bail are pivotally attached to opposite sides of the vessel. The bail is movable from a carrying position in which the bail extends above the top opening of the vessel to an inactive position in which the bail extends below the top opening and outside the wall of the vessel.

When a painter paints a surface while standing on a ladder the container is supported from the ladder by means of a pot hook. The pot hook consists of a rod-like device which is bent into a hook at each end. The larger hook at one end of the hanger is looped around one of the rungs of the ladder while the hook at the opposite end of the hanger is looped under the upright bail of the vessel. This makes it very awkward to dip the brush into the opening of the paint container. If the holder is slung over one of the rails of the ladder so that the bucket is located outside of the ladder rail, the movement by the painter is more natural. In either case, whether the container is located inside or outside the rails of the ladder, the bail of the can extends across the opening of the vessel and therefore presents an obstacle to the painter or other worker on the ladder.

Many people find working from a ladder is uncomfortable, awkward and frustrating to begin with and conventional pot hooks only add to this ill feeling by preventing access to the full opening of the pot with a brush, allowing the possibility of hitting the bail with the brush or hand thereby splattering the paint onto an unintended surface and making an unwanted mess on the bail and hook. Another intimidating factor for the inexperienced painter is the unstable nature of bucket suspension afforded by the common pot hook as the container is free to sway in general directions.

These and other difficulties found with the prior art bucket holding devices have been obviated in a novel manner by the present invention

SUMMARY

A bracket designed to support a paint bucket or similar vessel on the outside of a conventional modern ladder comprised of two rails and a plurality of rungs consisting of a generally -U-shaped form with the capability of attachment to a band and shaped so as to firmly hold onto a rail of said ladder and yet be easy to remove from the ladder with a simple upward motion. One segment, the inner segment is shaped to conform on its lower surface to the upper flat surface of a modern ladder rung. A center segment is of sufficient length to cover the width of a ladder rail and is set to the first segment so that the surface of its greatest plane is at an angle of 95 to 115 degrees to the plane of the first segment's lower surface. The third outer segment has on its largest surface a means of attachment to a band or strap which may allow movement of the bracket along said band or strap, said band or strap may be adjustable in circumference. A further variation consists of generally L-shaped form having a first segment as described above and a second segment at a right angle to the first segment of sufficient length to cover the rail of a ladder and at its outer end a formation which can mate to a properly formed protuberance on a molded vessel to allow said vessel to be suspended from a rail of said ladder and allow the bail of said vessel to lie in a resting position and the opening of said vessel to be free of any obstructions.

DETAILED DESCRIPTION

Figure 1:
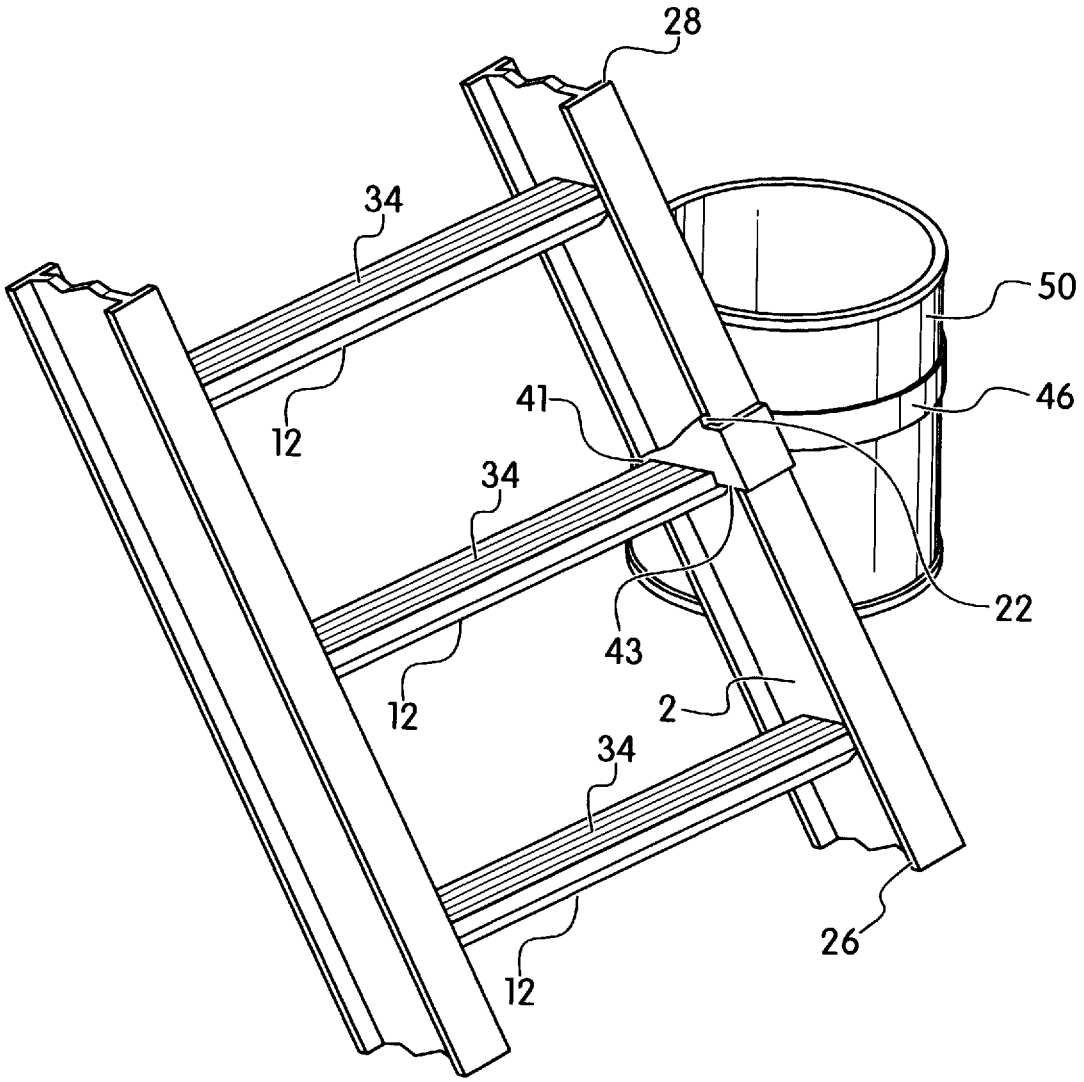
FIG. 1 shows one embodiment of the -U-shaped form bracket holding a vessel to the ladder rail and rung upper surface.
Figure 2:
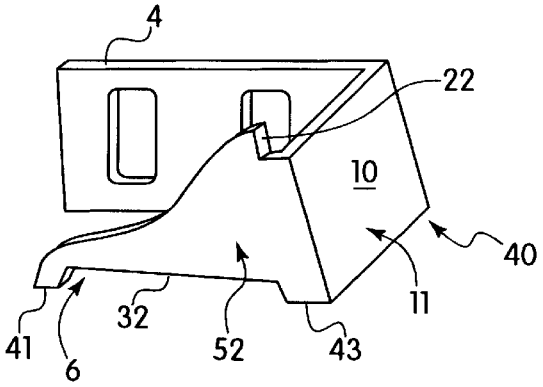
FIG. 2 shows a top perspective view of one side of the -U-shaped form bracket.
Figure 3:
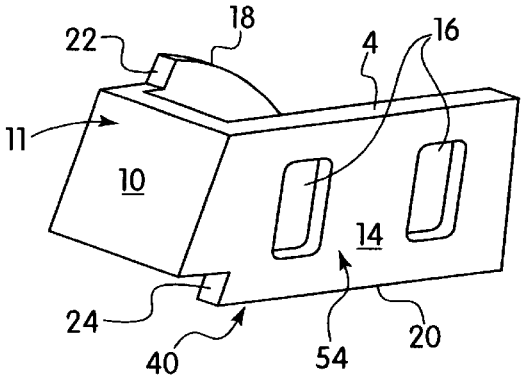
FIG. 3 shows a top perspective view of an opposite side of the -U-shaped form bracket.
Figure 4:
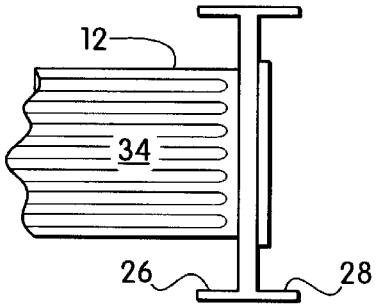
FIG. 4 shows a top sectional view of an I-beam shaped ladder rail and rung upper surface.
Figure 6:
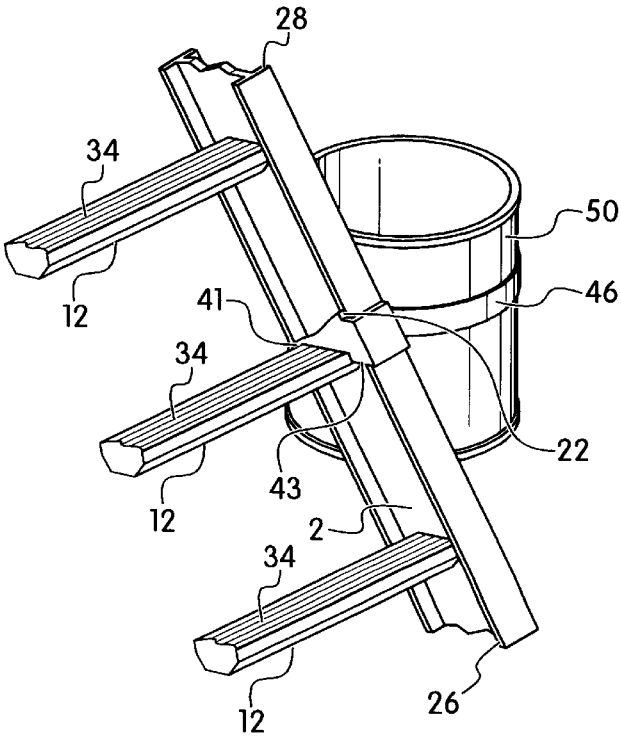
FIG. 6 shows a assembly view of the bucket bracket in use, or the -U- shaped form bracket holding a vessel to the ladder rail and rung upper surface.
Figure 5:
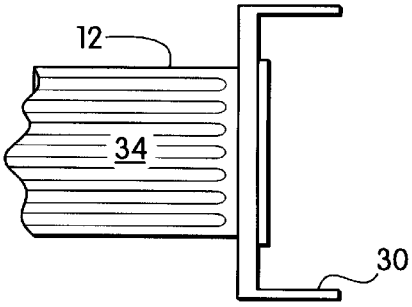
FIG. 5 shows a top sectional view of a C-shaped ladder rail and rung upper surface.
Figure 7:
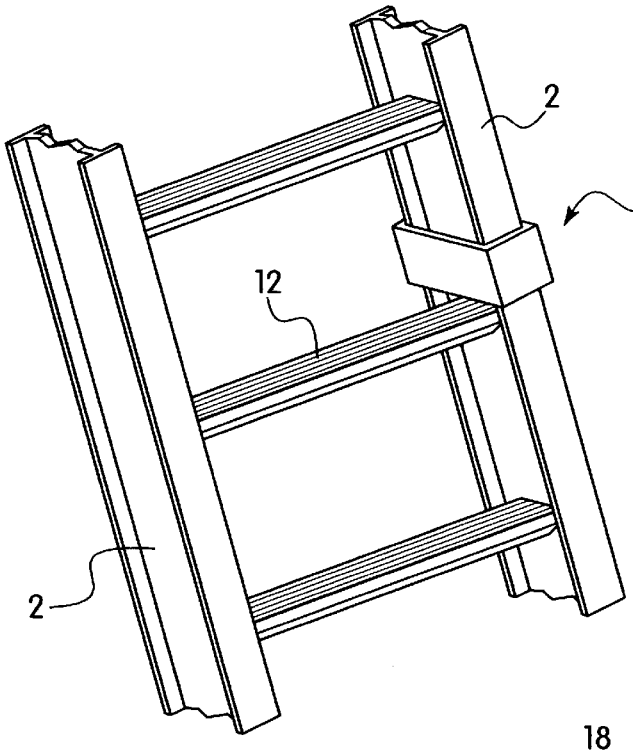
FIG. 7 shows an alternative embodiment of the -U-shaped member mounted on a ladder rail.
Figure 8:
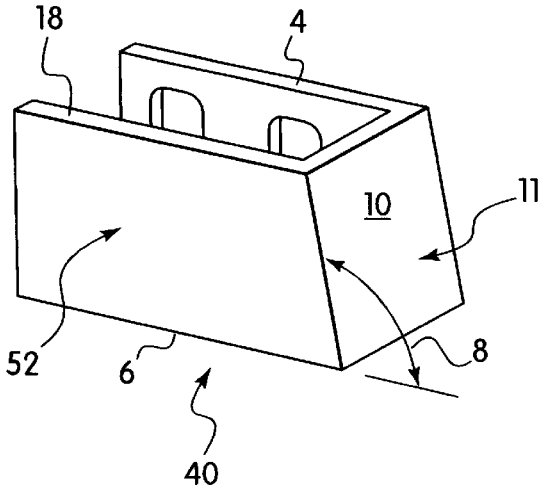
FIG. 8 shows a top and side perspective of one side of an alternative embodiment of the -U-shaped form bracket.
Figure 9:
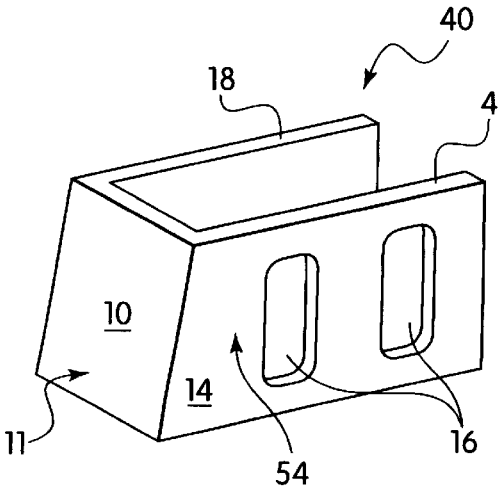
FIG. 9 shows a top and opposite side (from FIG. 8) perspective view of an alternative embodiment of the -U-shaped form bracket.

Referring to the drawings in detail the device is made as a generally -U-shaped form (40) made from a substance such as metal or plastic having sufficient rigidity for the task comprising three segments, an inner segment (52) connected to a center segment (11) which joins third outer segment (54), FIGS. 2 & 3, each of which has width and depth as well as length and which can fit loosely over a ladder rail (2) and having the outer upper (4) and inner lower (6) planes parallel to each other and set at an angle (8) of 95 to 115 degrees to the surface plane (10) of the center segment (11) so as to allow the forementioned planes (4) & (6) to be essentially level with the ground when the ladder is in proper use and the -U-shaped form (40) is surrounding a rail (2) and resting on a rung (12) of said ladder. Said -U-shaped form (40) having on its outer surface (14) a means of attachment (16) for a flexible strap (46) such attachment means (16) may allow movement along said strap (46) such attachment means (16) may be slots as illustrated or any of several other methods such as fusion or brackets. Said -U-shaped form (40) also having a locking projection (22) or notch (24), not limited to one, located on inner upper plane (18) and outer lower plane (20), respectively, such locking surfaces interfere with the modern aluminum ladder I beam projecting extensions (24), (28), as seen in FIG. 4, or fiberglass C section projecting extension (30), FIG. 5, through the action of gravity, thus preventing the -U-shaped member (40) from being dislodged to the rear in normal use yet being easily removed by an upward pull from the vessel's (50) bail (not shown). Said -U-shaped form (40) is further distinguished from all previously patented vessel hanging inventions by having a first hooklike section (41) and second hooklike section (43) formed in such a way as to conform to the rungs (12) found on modern extension ladders. Such first and second section (41),(43) being fashioned to provide a straight surface (32) which rests upon the full step width of a modern rung's flat upper surface (34). The above described -U-shaped form (40) is intended to be produced in mirror image -U-shaped form (not shown) to allow right and left handed operation either singly or in a pair, the mirrored unit being easily slid onto and positioned along the flexible strap (46).

I claim:

1. A device for holding a vessel to a ladder, the device comprising:

a U-shaped bracket having a center segment interconnecting an inner segment and an outer segment, the outer segment approximately parallel to the inner segment, a flexible strap for engagement with the outside of various sized vessels, the outer segment having an attachment means for engagement with the flexible strap, a notch located near the intersection of the outer segment and center segment, the notch for retaining the bracket on a ladder rail, the inner segment having a locking projection located diagonally across the center segment from the notch near the intersection of the center segment and inner segment for retaining the bracket on the ladder.

2. The device of claim 1 wherein:

the attachment means is at least one slot vertically oriented in the outer segment.

3. The device of claim 1 further comprising:

a straight surface located on an edge of the inner segment opposite the locking projection for location adjacent to the rung upper surface when the bracket is installed, a second hooklike section located on one end of the straight surface and a first hooklike section located at an opposite end of the straight surface.

4. The device of claim 1 the center segment is attached to the inner segment at an angle of between approximately 95–115 degrees relative to an inner lower plane of inner segment.

5. A device for holding a vessel to a ladder, the device comprising:

a U-shaped bracket with an inner segment forming a first leg of the bracket having a first hooklike section extending from an end of an inner lower plane and a corresponding second hooklike section extending from the inner lower plane on an opposite end, a straight surface located between the first hooklike section and a second hooklike section, the straight surface adjacent a rung upper surface when the bracket is installed on a ladder rail, an inner upper plane located opposite the inner lower plane having a locking projection located near the intersection of the inner segment and a center segment, the locking projection for retaining the bracket on the ladder rail;

the center segment interconnecting the inner segment and an outer segment, the center segment attached to the inner segment at an angle between approximately 95–115 degrees relative to the inner lower plane;

the inner segment and outer segment attached to the center segment such that the inner segment and outer segment are approximately parallel; and the outer segment having an outer upper plane on one edge and an outer lower plane on an opposite edge, a notch formed in the outer lower plane near the intersection of the center segment and the outer segment, the notch for engagement with a ladder rail, a flexible strap for attachment of a vessel to the bracket, an attachment means centrally located in the outer segment for attachment of the flexible strap.

6. The device of claim 5, wherein:

the attachment means is at least one vertical slot in the outer segment.

7. The device of claim 5, wherein:

the flexible strap is adjustable to many different sized vessels.

* * * * *